US005411066A

United States Patent [19]

Tsuda

[11] Patent Number: 5,411,066

[45] Date of Patent: May 2, 1995

[54] METHOD OF PRODUCING VENEER

[76] Inventor: Sotaro Tsuda, 4-13, Nekogahora-dori, Chikusa-ku, Nagoya, Aichi-ken, Japan

[21] Appl. No.: 143,016

[22] Filed: Oct. 29, 1993

[51] Int. Cl.[6] ..... B27C 1/00; B27D 1/00; B27L 5/00

[52] U.S. Cl. ..... 144/348; 144/213; 144/209 R; 144/346; 144/352; 144/380; 156/250; 156/252; 156/299; 428/326; 428/528

[58] Field of Search ..... 144/209 R, 212, 213, 144/365, 345, 346, 348, 352; 156/250, 252, 299, 321, 325; 427/209, 208.02, 208.04; 428/326, 528

[56] References Cited

U.S. PATENT DOCUMENTS

| | | | |
|---|---|---|---|
| 871,231 | 11/1907 | Merritt | 144/213 |
| 2,607,378 | 8/1952 | Merritt | 144/213 |
| 5,159,963 | 11/1992 | Paajanen | 144/213 |

FOREIGN PATENT DOCUMENTS

| | | |
|---|---|---|
| 55-26961 | 7/1980 | Japan . |
| 56-16729 | 4/1981 | Japan . |
| 59-19007 | 5/1984 | Japan . |
| 61-21805 | 5/1986 | Japan . |
| 62-16803 | 4/1987 | Japan . |
| 63-7122 | 2/1988 | Japan . |
| 1-4881 | 1/1989 | Japan . |
| 1-37243 | 8/1989 | Japan . |
| 2-185402 | 7/1990 | Japan . |
| 5-4202 | 1/1993 | Japan . |

*Primary Examiner*—W. Donald Bray
*Attorney, Agent, or Firm*—Lowe, Price, LeBlanc & Becker

[57] ABSTRACT

A method of producing a veneer having a given thickness requires cutting of a stock material by a mechanism including a rotary lathe blade and a nose bar. The nose bar is arranged at the outer periphery of the stock material in the vicinity of the tip of the rotary lathe blade, such that the spacing between the tip of the nose bar and the tip of the rotary lathe blade in a horizontal direction is 20 to 30% smaller than the thickness of the desired veneer to be cut. The stock material is cut by rotating the stock material by a spindle which chucks the end faces of the stock material at opposite ends thereof. A backup roller rotated by the rotation of the stock material constantly biases the stock material toward the nose bar and is positioned on the outer periphery of the stock material in a position diametrically opposite to the rotary lathe blade.

14 Claims, 3 Drawing Sheets

METHOD OF PRODUCING VENEER

BACKGROUND OF THE INVENTION

1. Field of the Invention

The present invention relates to a method of producing a veneer for laminated veneer lumber which is widely used for furniture frameworks, structural members for frameworks, steps, windows, doors, flooring and surfaces.

2. Related Art

Laminated veneer lumber (hereinafter abbreviated to as "LVL") having a thickness of about 9 to 70 mm is made of veneers each having a thickness of about 2 to 4 mm which are cut from logs of broad-leaved trees or needle-leaved conifers by means of a rotary lathe or slicer and are laminated and bonded to each other so that the directions of the fibers are in parallel with each other.

For example, a veneer 20*a* which constitutes such an LVL is produced by a method as follows: a stock material 20 having a thickness of about 1200 to 3000 mm is rotatably chucked by a spindle 21 at the center of opposite end faces thereof as shown in FIG. 2. A rotary lathe blade 22 having a nose angle of about 20° to 23° is provided to enable the stock material 20 to be cut at a thickness of about 2 to 4 mm. The nose bar 23 is arranged so that the front and of the nose bar 23 is positioned above the cutting edge of the rotary lathe blade 22. The stock material 20 is continuously rotated in a given direction represented by an arrow by energizing a spindle driving mechanism 24 which is associated with the spindle 21. The veneer is thus continuously produced by cutting the stock material 20 at a given thickness by the rotary lathe blade 22.

However, since the spindle 21 which rotatably supports the stock material 20 has a diameter which is very much smaller than that of the stock material 22, the spindle 21 is unable to smoothly rotate the stock material 20 unless an output torque from the spindle driving mechanism 24 is large.

The veneer which is cut out from the base material is wavy and is not smooth over the entire surface.

Accordingly, a rotary saw-like drive roll 26 which is provided with a multiplicity of engaging teeth 25 along the outer periphery thereof as shown in FIG. 3 is set in a position equal to or above the nose bar 23. The drive roll 26 is operated simultaneously with the driving of the spindle 21 to start the cutting of the stock material 20. The stock material 20 is caused to be rotated by penetrating the teeth 25 of the drive roll 26 into the stock material 20. When the diameter of the stock material 20 is decreased by the cutting, either of the spindle 21 or the drive roll 26 is turned off. The veneer 20*a* is produced by cutting the stock material 20 with either one of the spindle 21 or the drive roll 26.

Cutting of the stock material 20 using the spindle 21 together with the rotary saw-like drive roll 26 having a multiplicity of teeth 25 along the outer periphery thereof decreases the necessary output torque of the spindle drive mechanism 24.

Since the cut veneer 20*a* is punched on the right side thereof by the teeth 25 of the drive roll 26, a tenderizing effect occurs resulting in that a veneer which is relatively smooth over the entire surface thereof can be produced.

However, a multiplicity of punched holes are formed over the entire surface of the cut veneer 20*a*. In other words, cracks are inevitably formed on the right side of the veneer. The veneer is cut from the base material as if a screen were dispersed from a roll. These cracks will be referred to as "right side cracks". The radial length between the center of the stock material 20 and the cutting edge of the rotary lathe blade 5 differs from the radial length between the center of the stock material 20 and the front end of the nose bar 4.

As a result of this, part of the stock material 20*a* is deformed in front of the cutting edge of the rotary lathe blade due to lateral compression. Formation of cracks at predetermined intervals on the reverse side of the cut veneer is inevitable as shown in FIGS. 2 and 3. These cracks will be referred to as "reverse side cracks".

In an LVL 10 in which the veneers which are thus produced by the known method are laminated and bonded to each other with a bonding agent, the veneers 10*a*, 10*b*, 10*c*, 10*d* and 10*e* which constitutes the LVL 10 per se have the reverse side cracks as well as a multiplicity of punched holes on the right side thereof as shown in FIG. 4.

Accordingly, if the LVL 10 comprising laminated such veneers each having cracks on the opposite sides thereof is subjected to cutting or surface curving working by means of a molder, part of the fibers or fiber bundle remains on the cut or worked surface, resulting in wool or fuzzy grains on the surface thereof.

In an extreme case, fiber bundles are cut away from the surface, resulting in shallow depressions.

Accordingly, in order to coat the LVL for surface finishing, it is necessary to pretreat the cut or worked surface of the LVL by sanding the surface to provide smoothness or filling depressions with putty. Therefore, the LVL is not necessarily advantageous as a lumber product.

SUMMARY OF THE INVENTION

It is, therefore, an object of the present invention to provide a method of producing a flaw-free veneer for use as LVL having few cracks on the surfaces thereof in which part of fibers or fiber bundles does not remain or is not cut away to form depressions after cutting or working of curved surface of the LVL.

In order to accomplish the above-mentioned object, there is provided a method of producing a veneer having a given thickness by cutting a stock material by cutting means including a rotary lathe blade and a nose bar characterized in that the nose bar is arranged at the outer periphery of the stock material in the vicinity of the cutting edge of the rotary lathe blade so that the spacing between the front end of the nose bar and the cutting edge of the rotary lathe blade in a horizontal direction is 20 to 30% smaller than the thickness of the desired veneer to be cut and in that the stock material is cut by driving the stock material by means of a spindle which chucks the end faces of the stock material at the opposite ends thereof while a backup roller which is rotated by the rotation of the stock material and constantly biases the stock material toward the nose bar is arranged on the outer periphery of the stock material in a position diametrically opposite to the rotary lathe blade.

In accordance with the method of producing a veneer of the present invention, the spacing between the cutting edge of the rotary lathe blade and the front end of the nose bar in a horizontal direction is 20 to 30% smaller than the thickness of the veneer to be desired.

This causes the veneer which is cut out from the stock material with the rotary lathe blade to be constantly biased toward the stock material by the nose bar. This suppresses the lifting up of the veneer to be cut to prevent deformation of the veneer due to lateral compression in front of the cutting area from occurring. Therefore, no cracks will be formed on the reverse side of the veneer to be cut.

Since cutting of the stock material with the rotary lathe blade is achieved with only the output torque from the spindle, cracks are not formed on the right side of the veneer unlike the prior art cutting with a drive roll.

Therefore, it is possible to produce a veneer which is free of cracks on the right and reverse sides thereof, which are otherwise inevitable in the prior art.

Particularly, a veneer which is more free of flaws can be produced by making the spacing between the cutting edge of the rotary lathe blade and the front end of the nose bar in a vertical direction 0.3 to 0.7 mm.

Since the stock material is always biased toward the rotary lathe blade by the backup roller, no bending occurs in the stock material.

Accordingly, since the cutting rate of the stock material achieved with the rotary lathe blade is constant. A veneer having a uniform thickness can be produced.

Since a force is constantly applied to the center of the stock material due to the fact that the axes of the spindle for chucking and supporting the stock material and the backup roller are aligned with the front end of the nose bar in a horizontal direction. This enables smooth cutting to be conducted even when the diameter of the stock material is decreased.

An LVL can be thus produced from flaw-free veneers having no cracks on the opposite sides thereof.

Therefore, fuzzing or formation of depressions due to cutting away of fiber bundles does not occur on the cut or curving worked surface of the LVL even if the LVL is subjected to cutting according to applications or surface curving working with a molder.

As a result, no pretreatment such as sanding a portion to be cut or putty filling a curved surface is necessary for surface finishing coating.

DESCRIPTION OF A PREFERRED EMBODIMENT

Now, a method of producing a veneer of the present invention will be described with reference to drawings.

Figure 1:
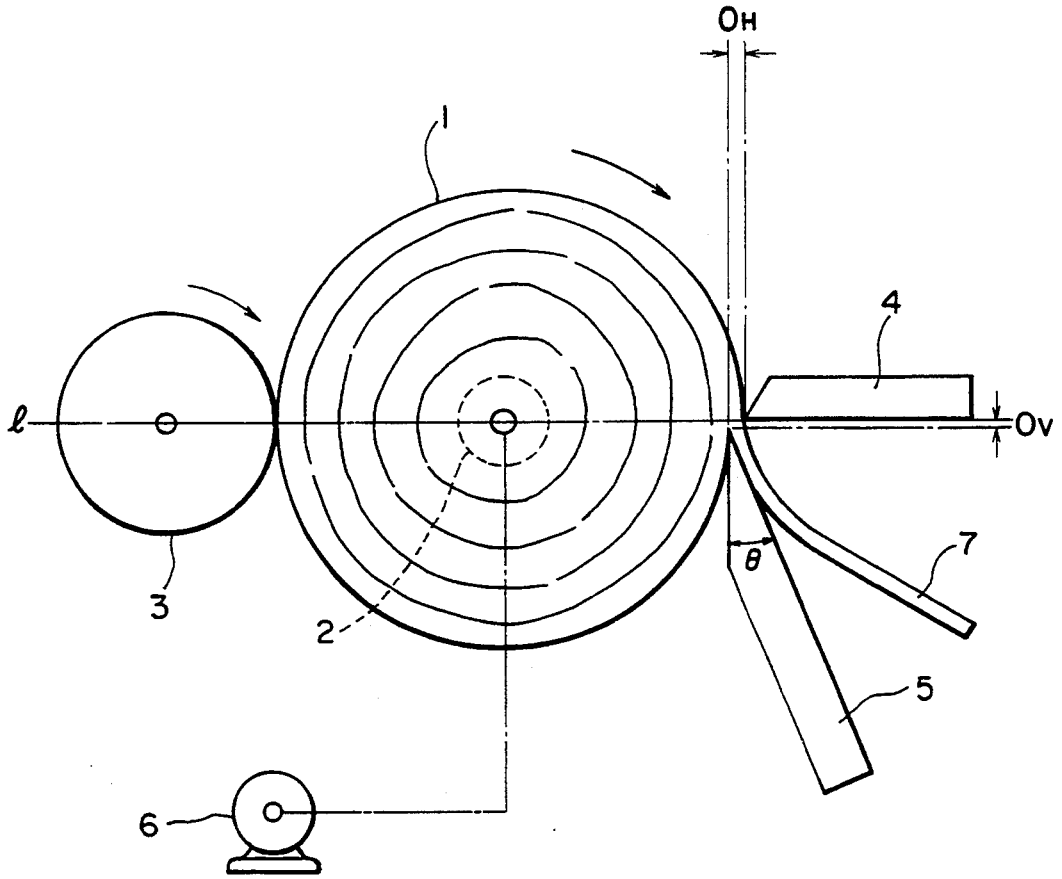
FIG. 1 is a schematic elevational view for explaining a preferred embodiment of a method of producing a veneer of the present invention.
Figure 2:
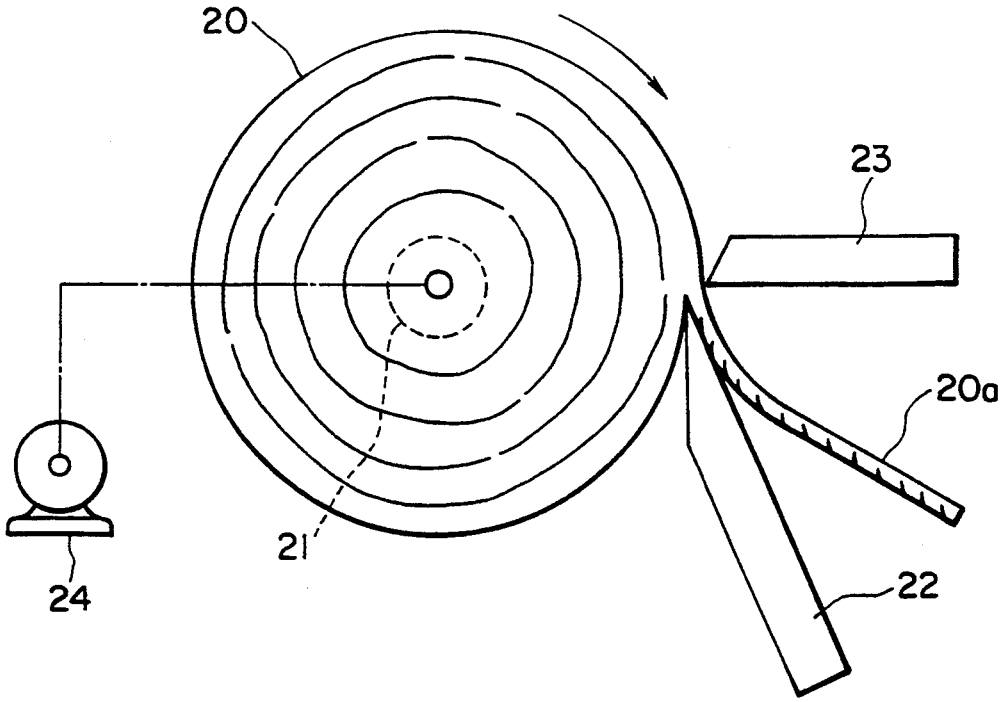
FIG. 2 (PRIOR ART)
FIG. 2 is a schematic elevational view for explaining a prior art method of producing a veneer.
Figure 3:
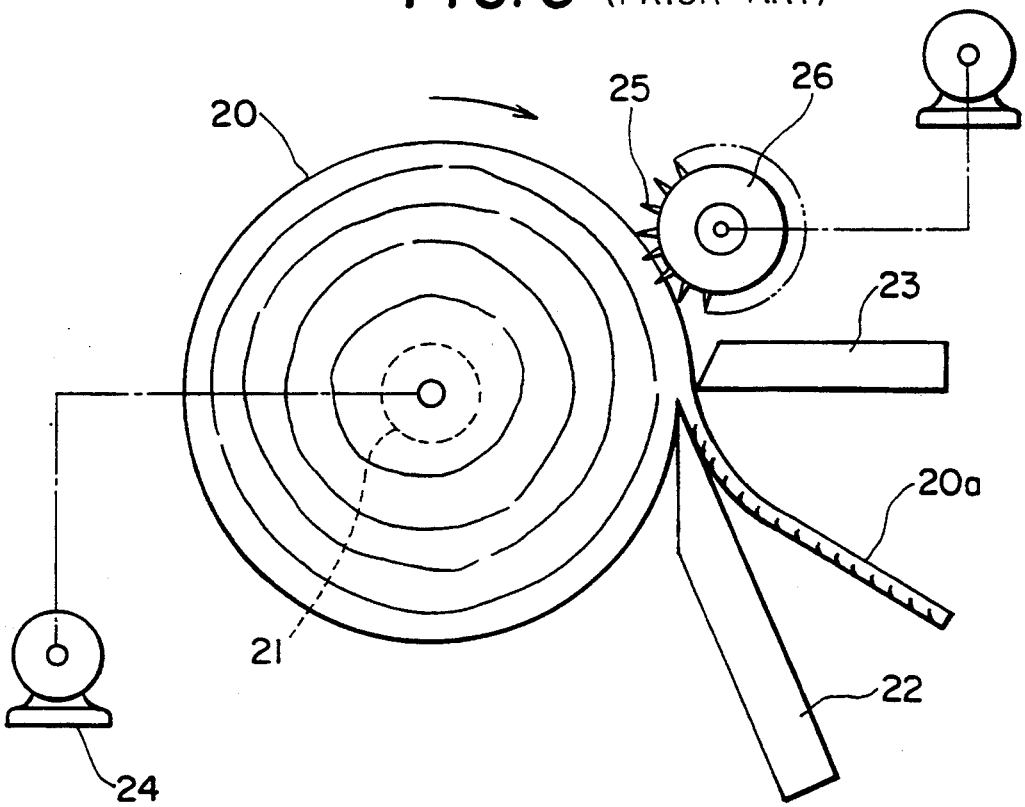
FIG. 3 (PRIOR ART)
FIG. 3 is a schematic elevational view for explaining a prior art method of producing a veneer by using a rotary saw-like drive roll.
Figure 4:
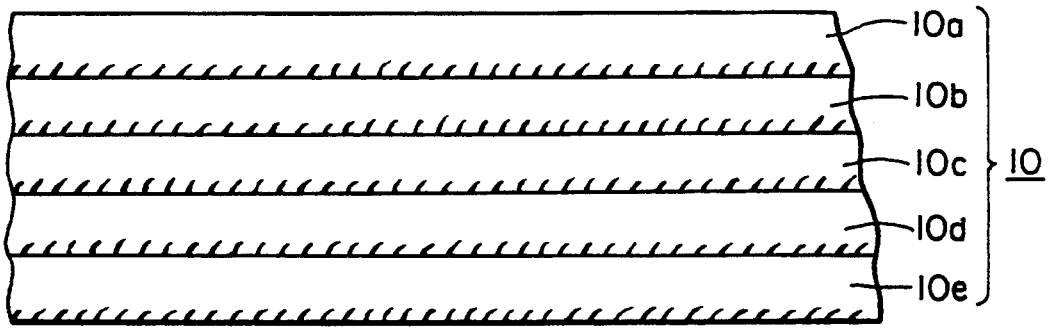
FIG. 4 (PRIOR ART)
FIG. 4 is an elevational view showing a LVL which is made of the veneers which are produced by a machine shown in FIG. 3.

Referring now to FIG. 1, there is shown a schematic elevational view explaining a preferred embodiment of a method of producing a veneer of the present invention.

A stock material 1 is cut from, for example, a log of yellow poplar and has a length of about 1500 mm. The stock material 1 is rotatably supported at the opposite ends thereof by a spindle chuck 2 which chucks cut end faces. A backup roller 3 is in contact with the stock material 1 in a position diametrically opposite to a cutting position.

The backup roller 3 per se does not have drive means for rotating the same, but is driven to rotate with the rotation of the stock material 1 and is constantly in contact with the stock material 1 and biases the stock material toward to a nose bar 4.

A preset pressure is constantly applied to the nose bar 4 due to a biasing force of the backup roller 3 even if the stock material 1 is gradually decreased in diameter by cutting. Accordingly, the depth of cutting which is achieved with a rotary lathe blade 5 is constantly kept constant.

The rotary lathe blade 5 usually has a nose angle $\theta$ of 20° to 23° . It is preferable that the blade has a nose angle $\theta$ of 20° or less to decrease the lateral compression deformation in front of the rotary lathe blade 5 which otherwise occurs on cutting of the stock material 1.

The rotary lathe blade 5 and the nose bar 4 are arranged with respect to the stock material 1 such that the spacing OH between the cutting edge of the rotary lathe blade 5 and the front end of the nose bar 4 in a horizontal direction is 20 to 30% smaller than the thickness of the veneer to be cut.

For example, if it is assumed that the veneer to be cut is 2.5 mm in thickness, the spacing OH between the rotary lathe blade 5 and the nose bar 4 in a horizontal direction is set to 2.0 to 1.75 mm.

By arranging the spindle chuck 2, the backup roll 3 and the nose bar 4 so that the axes of the spindle chuck 2 and the backup roll 3 and the front end of the nose bar 4 are aligned with a common line 1 in a horizontal direction, a force is constantly applied to the core area of the stock material 1 even if the diameter of the stock material 1 is decreased as it is cut. Therefore, this makes a smoother cutting operation possible.

When a spindle drive mechanism 6 which is operatively connected with the spindle 2 is driven after the rotary lathe blade 5 and the nose bar 4 have been set with respect to the stock material 1 to meet the above mentioned conditions, the stock material 1 is also rotated in a direction represented by an arrow in association with the spindle 2 and a veneer 7 is cut from the stock material 1 with the rotary lathe blade 5.

The rotary lathe blade 5 has a tendency to lift up the veneer 7 cut from the stock material 1 on cutting. The cut veneer 7 is forcedly biased back toward stock material 1 on the outer side. Therefore, the right side cracks due to the rotary lathe blade 5 are prevented from occurring. Simultaneously, cracks on the reverse side of the veneer 7 do not occur since the veneer 7 is pulled out while it is squeezed.

A denser and more flaw-free veneer can be produced by making the spacing OV between the rotary lathe 5 and the nose bar 4 in a vertical direction 0.3 to 0.7 mm, preferably 0.5 mm irrespective of the desired veneer thickness.

Even if the diameter of the stock material 1 decreases as cutting advances, bending of the stock material in a outer radial direction at the longitudinally intermediate portion of the stock material 1 will not occur since the stock material 1 is biased toward the cutting position at the opposite position thereof by the backup roller 3.

Accordingly, the force which is applied to the stock material 1 by the nose bar 4 is always constant so that stable cutting can be performed.

The veneer which is obtained by the method of the present invention contains excessive water content although the veneer has no cracks on the right and reverse sides thereof, that is, it is flaw-free. Accordingly, the veneer is dried to adjust the water content to 10% or less.

Since the veneer which has been subjected to a drying step is wavy over the entire surface thereof, it is alternatively subjected to hot and cold compressions with hot and cold press machines, respectively, so that the veneer exhibits smooth surfaces over the entirety thereof.

The compression may be achieved by only the hot press machine. In other words, means for smoothing the surfaces of the veneer is not limited to those of the foregoing embodiment as long as it is capable of smoothing rough or wavy surfaces over the entirety thereof.

The veneers each having smoothed surfaces over the entirety thereof are laminated and bonded to each other with a bonding agent to provide an LVL having a predetermined thickness.

The veneers having smoothed surfaces are laminated to each other so that the wood fibers therein are in parallel with each other. The preferable bonding agents include synthetic resin bonding agents such as vinyl acetate resin, urea resin, and phenol resin bonding agents.

The thus laminated and bonded LVL are cut to a given length according to the applications, or subjected to surface curving working with a molder. Since the veneers which form an LVL are free of cracks, no wool or fuzzy grains and/or depressions are formed on cutting.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of producing a veneer having a selected thickness, by cutting a stock material which is rotated by a spindle, with cutting means including a rotary lathe blade and a nose bar, comprising the steps of:

positioning the nose bar at an outer periphery of the stock material in the vicinity of a cutting edge of the rotary lathe blade such that a spacing between a front end of the nose bar and the cutting edge in a horizontal direction is 20 to 30% smaller than the selected thickness; and applying a backup roller rotated by the rotation of the stock material to constantly push the rotating stock material toward the nose bar, the backup roller being contacted to the outer periphery of the stock material at a position diametrically opposite to the rotary lathe blade.

2. The method of producing a veneer according to claim 1, wherein:

the spacing between the cutting edge of the rotary lathe blade and the front end of the rotary lathe blade in a vertical direction is in the range 0.3 to 0.7 mm.

3. The method of producing a veneer according to claim 1, wherein:

an axis of a spindle rotating the stock material, an axis of the backup roller, and the front end of the nose bar are on a common horizontal plane.

4. The method of producing a veneer according to claim 2, wherein:

an axis of a spindle rotating the stock material, an axis of the backup roller, and the front end of the nose bar are on a common horizontal plane.

5. The method of producing a veneer according to claim 1, comprising the further step of:

drying the veneer to adjust the water content thereof to 10% or less.

6. The method of producing the veneer according to claim 3, comprising the further step of:

drying the veneer to adjust the water content thereof to 10% or less.

7. The method of producing the veneer according to claim 5, comprising the further step of:

subjecting the dried veneer to alternate hot and cold compressions to obtain smooth surfaces over the entirety of the veneer.

8. The method of producing the veneer according to claim 6, comprising:

drying the veneer to adjust the water content thereof to 10% or less.

9. The method of claim 5, comprising the further step of:

subjecting the dried veneer to hot compression.

10. The method of claim 9, wherein:

an axis of a spindle rotating the stock material, an axis of the backup roller, and the front end of the nose bar are on a common horizontal plane.

11. The method of producing a veneer according to claim 8, comprising the further step of:

laminating and bonding a plurality of the direct and compressed veneers to each other with a bonding agent.

12. The method of producing a veneer according to claim 9, comprising the further step of:

laminating and bonding a plurality of the direct and compressed veneers to each other with a bonding agent.

13. The method of producing a veneer according to claim 9, wherein:

said bonding is performed by use of a bonding agent selected from a group consisting of vinyl acetate resin, urea resin, and phenol resin bonding agents.

14. The method of producing a veneer according to claim 12, wherein:

said bonding is performed by use of a bonding agent selected from a group consisting of vinyl acetate resin, urea resin, and phenol resin bonding agents.

* * * * *